US006568107B2

(12) United States Patent
Yuen

(10) Patent No.: US 6,568,107 B2
(45) Date of Patent: May 27, 2003

(54) ORNAMENTAL DISPLAY RECEPTACLE

(76) Inventor: Wang Sing Yuen, 11/F, Flat D, Block 2, Tai Ping Ind. Centre 55 Ting Kok Rd., Tai Po, N.T., Hong Kong (HK)

( * ) Notice: Subject to any disclaimer, the term of this patent is extended or adjusted under 35 U.S.C. 154(b) by 220 days.

(21) Appl. No.: 09/773,019

(22) Filed: Jan. 31, 2001

(65) Prior Publication Data

US 2002/0020089 A1 Feb. 21, 2002

Related U.S. Application Data

(63) Continuation-in-part of application No. 09/635,572, filed on Aug. 9, 2000.

(60) Provisional application No. 60/173,512, filed on Dec. 29, 1999.

(51) Int. Cl.[7] ..... B09F 19/00

(52) U.S. Cl. ..... 40/406; 40/410; 40/426

(58) Field of Search ..... 40/406, 410, 426

(56) References Cited

U.S. PATENT DOCUMENTS

| | | | | |
|---|---|---|---|---|
| 1,485,641 A | | 3/1924 | Sparks | |
| 2,323,837 A | | 7/1943 | Neal | |
| 2,544,949 A | | 3/1951 | Daniel | |
| 3,006,111 A | | 10/1961 | Koch | |
| 3,239,956 A | | 3/1966 | Canonica, Jr. | |
| 3,295,252 A | | 1/1967 | Willette | |
| 3,425,157 A | | 2/1969 | Hartsock | |
| 4,490,931 A | * | 1/1985 | Fleemin | 40/409 |
| 4,552,542 A | | 11/1985 | Reysman | |
| 4,757,986 A | | 7/1988 | Hwang et al. | |
| 4,852,283 A | | 8/1989 | Teng | |
| 5,510,570 A | | 4/1996 | Liu | |
| 5,620,353 A | * | 4/1997 | Lai | 40/410 |
| 5,665,926 A | | 9/1997 | Chen | |
| 5,696,332 A | | 12/1997 | Yang | |
| 5,705,759 A | | 1/1998 | DeVivo | |
| 6,006,461 A | * | 12/1999 | Snyder | 40/426 |
| 6,078,000 A | | 1/2000 | Chen | |
| 6,282,820 B1 | * | 9/2001 | White et al. | 40/426 |

* cited by examiner

*Primary Examiner*—Cassandra H. Davis
(74) *Attorney, Agent, or Firm*—Shlesinger, Arkwright & Garvey LLP

(57) ABSTRACT

This invention deals with an ornamental display receptacle which has a transparent envelope which contains a clear fluid and a particulate such as artificial snow or leaves or the like, which is suspendable in the fluid upon agitation, thus simulating falling snow, leaves or the like, and which includes a power driven agitator which will maintain the particulate in suspension so long as the motor is in the ON. The particulate will be at rest in the display receptacle when the motor driven agitator is not operating. An ornament, such as a house or an individual or the like, will be positioned in the receptacle to enhance the simulation of activity around the ornamental object.

9 Claims, 4 Drawing Sheets

ORNAMENTAL DISPLAY RECEPTACLE

This application is based on Provisional Application No. 60/173,512, filed on Dec. 29, 1999. This application is a continuation-in-part of application Ser. No. 09/635,572, filed Aug. 9, 2000.

INVENTION

The invention relates to ornamental devices of the nature called "snowballs" or "snowglobes" wherein a material is suspendable in a clear liquid observable through a transparent envelope and in which there is a particulate which when the fluid is agitated, will take on the appearances of snow, confetti, leaves, sand or the like falling on a scene within the envelope such as a house or trees or individuals or the like.

HISTORICAL BACKGROUND

"Snowglobes" have been known for many years. They usually include a Christmas scene or a replica of a well known scene such as a winter scene in which the White House, a covered bridge, Nativity or the like is disclosed which can be shaken by hand so that the artificial snow will be mixed in the fluid to give the appearance of snow falling, etc. These devices are readily available in retail stores and souvenir outlets. Some of the devices may include a music box. Unfortunately the ornamental devices are so constructed that the particulate material used to simulate snow or leaves or the like, will not stay in suspension for any great length of time and will eventually fall to the bottom of the device until shaken once again.

In recent years patents have issued such as Teng, U.S. Pat. No. 4,452,283 and Chen, U.S. Pat. No. 6,078,000, which are motor driven and move the particulate particles in the ball by means of a type of agitator. Hwang et al., U.S. Pat. No. 4,757,986, shows a water ball in which the main character rotates with musical accompaniment.

All of the above mentioned inventions used magnetic means to rotate the figure in the fluid.

OBJECTS AND SUMMARY OF THE INVENTION

It is an object of this invention to provide an ornamental display receptacle which will maintain the particulate in suspension as long as desired without manipulating the device.

Still another object of this invention is to provide an ornamental display receptacle which has an agitator which is power driven and which can be turned OFF and ON as desired.

Another object of this invention is to provide an ornamental display receptacle which is inexpensive and easy to manufacture and which provides entertainment for extended periods of time without manipulation by an individual.

It is another object of this invention to be able to provide a suspendable particulate in a liquid display device in which the particulate can be agitated at various rates of speed to give certain effects such as a light snowfall, moderate snowfall or blizzard type conditions.

A further object of this invention is to provide an agitation mechanism design to circulate the fluid whereby the display statue or article remains stationary within the ball while the fluid is agitated sufficiently to move the particulate material.

In summary this invention relates to ornamental display receptacles which contained a fluid in a particulate in the fluid which can be agitated without manual manipulation.

These and other objects of the present invention will be apparent from the following description including the drawings in which:

BRIEF DESCRIPTIONS OF THE DRAWINGS

DETAILED DESCRIPTION OF THE INVENTION

Figure 1:
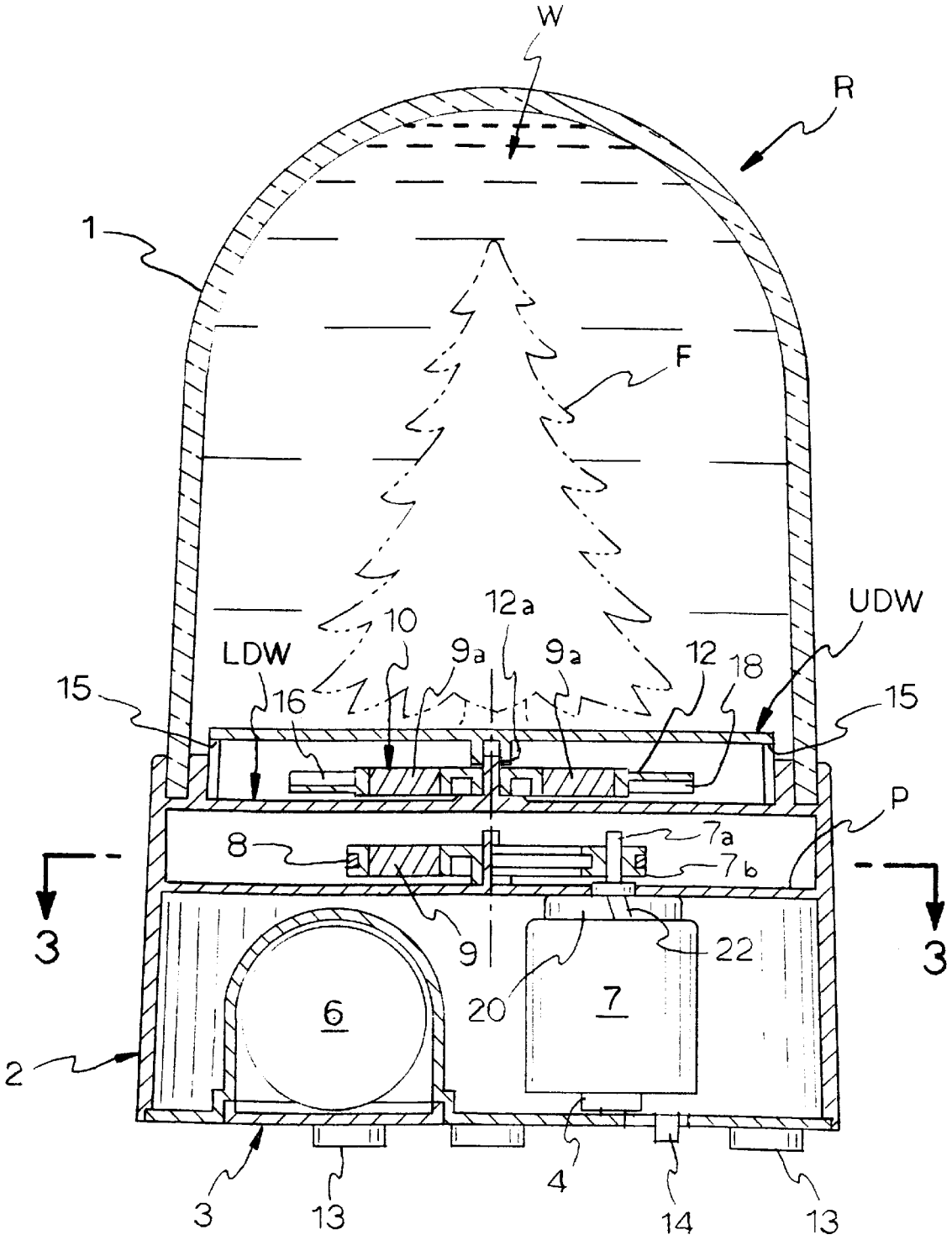
FIG. 1 is a cross sectional view of the invention.

In the drawings, the housing display receptacle R includes the transparent envelope 1 and the base 2. A battery receptacle 3 is mounted in the base 2. Motor mount 4 is in the base 2.

The base bottom is 5. Battery 6 is provided in the battery receptacle 3. The motor 7 through drive shaft 7*a* and pinion 7*b* drives a belt drive 8. Magnets 9 are positioned on a drive wheel 10. The belt drive B is driven by a drive wheel pinion 7*b* mounted on drive shaft 7*a*. A driven wheel 12 on shaft 12*a* has mounted therein magnets 9*a* similar to the magnets 9 that are in the drive wheel 10. The receptacle R includes a lower driven wheel support panel LDW and upper driven wheel support panel UDW which comprise a portion of base 2. A figurine or ornament F is shown in phantom in FIG. 1. Drive wheel 10 and driven wheel 12, as noted in FIG. 1, are horizontally disposed on parallel planes. The drive wheel 10 and the driven wheel 12 are axially aligned.

Pads 13 add support to the base 2. An ON/OFF switch 14 is provided for turning on or off the motor 7. Openings or perforations 15 allow for circulation of fluid W. A music box (not shown) can be included in the base 2.

Pads 13 add support to the Drive wheel 10 and driven wheel 12, as noted in FIG. 1 are horizontally disposed on parallel planes. The drive wheel 10 and the driven wheel 12 are axially aligned; base 2. An ON/OFF switch 14 is provide for turning on or off the motor 7. Openings or perforations. 15 allow for circulation of fluid W. A music box (not shown) can be included in the base 2.

Figure 2:
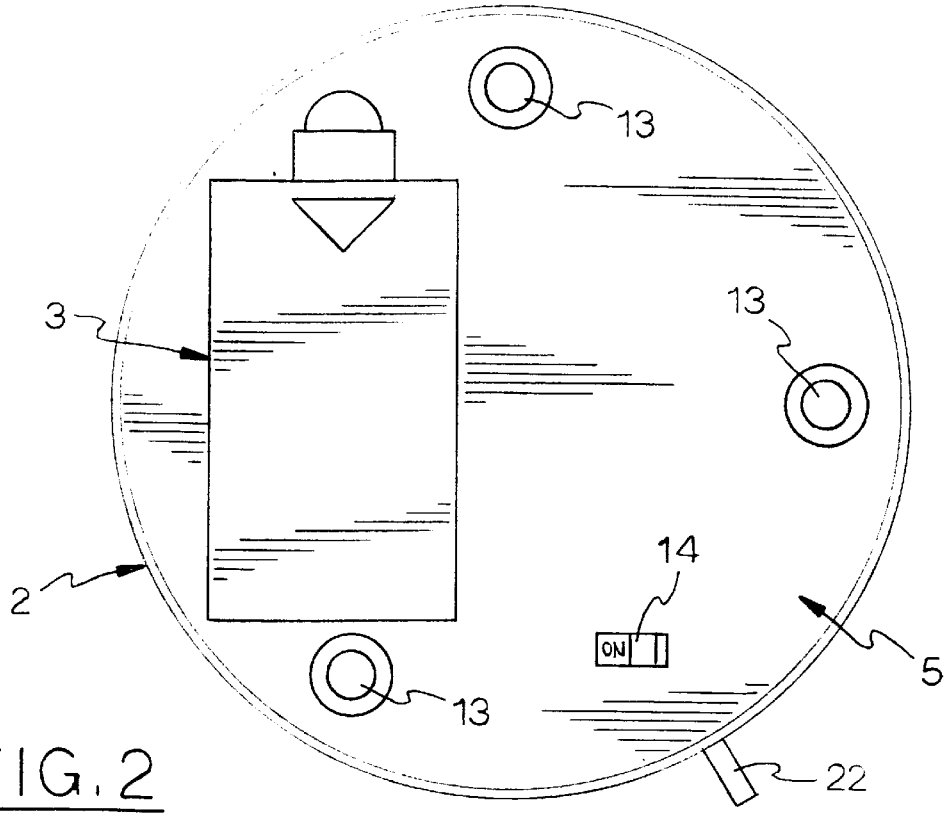
FIG. 2 is the bottom plan view of the invention.
Figure 3:
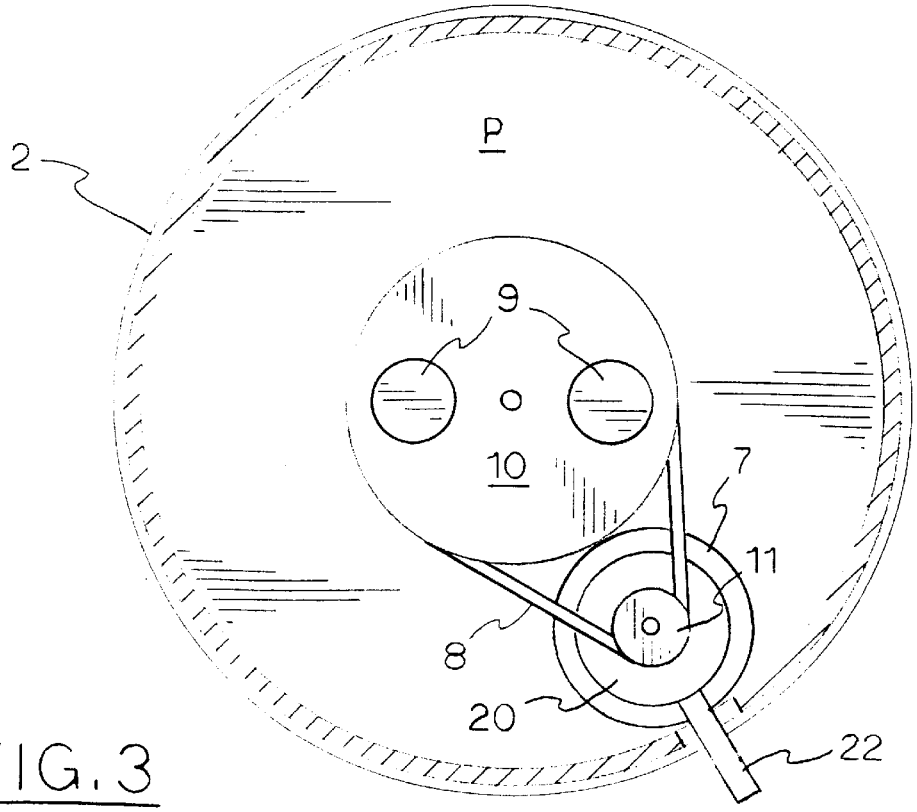
FIG. 3 is a cross sectional view showing the belt drive system.

Operation of FIGS. 1–3

When motor 7 is turned on, the drive wheel 10 with magnets 9 will cause the driven wheel 12 to rotate due to the magnetic forces of the magnets 9 in the driven wheel 10 on the magnets 9 in the driven wheel 12. The drive wheel 12 is sealed in the transparent envelope 1 containing the clear fluid W. The driven wheel 12 may have impeller, such as blades 16 and 18, bumps, recesses or the like. Once the driven wheel 12 rotates, the fluid W in the transparent envelope 1 will start to move from the bottom and become suspended in the transparent envelope 1 passing in and out of the holes 15. The motor 7 may have a speed regulator 20 with a lever 22 to vary the speed of motor shaft 7*a* to cause the particles to circulate at different speeds. Speed reduction can be accomplished by a variable pulley, gearing, shaft friction device, motor rheostat or the like.

Figure 4:
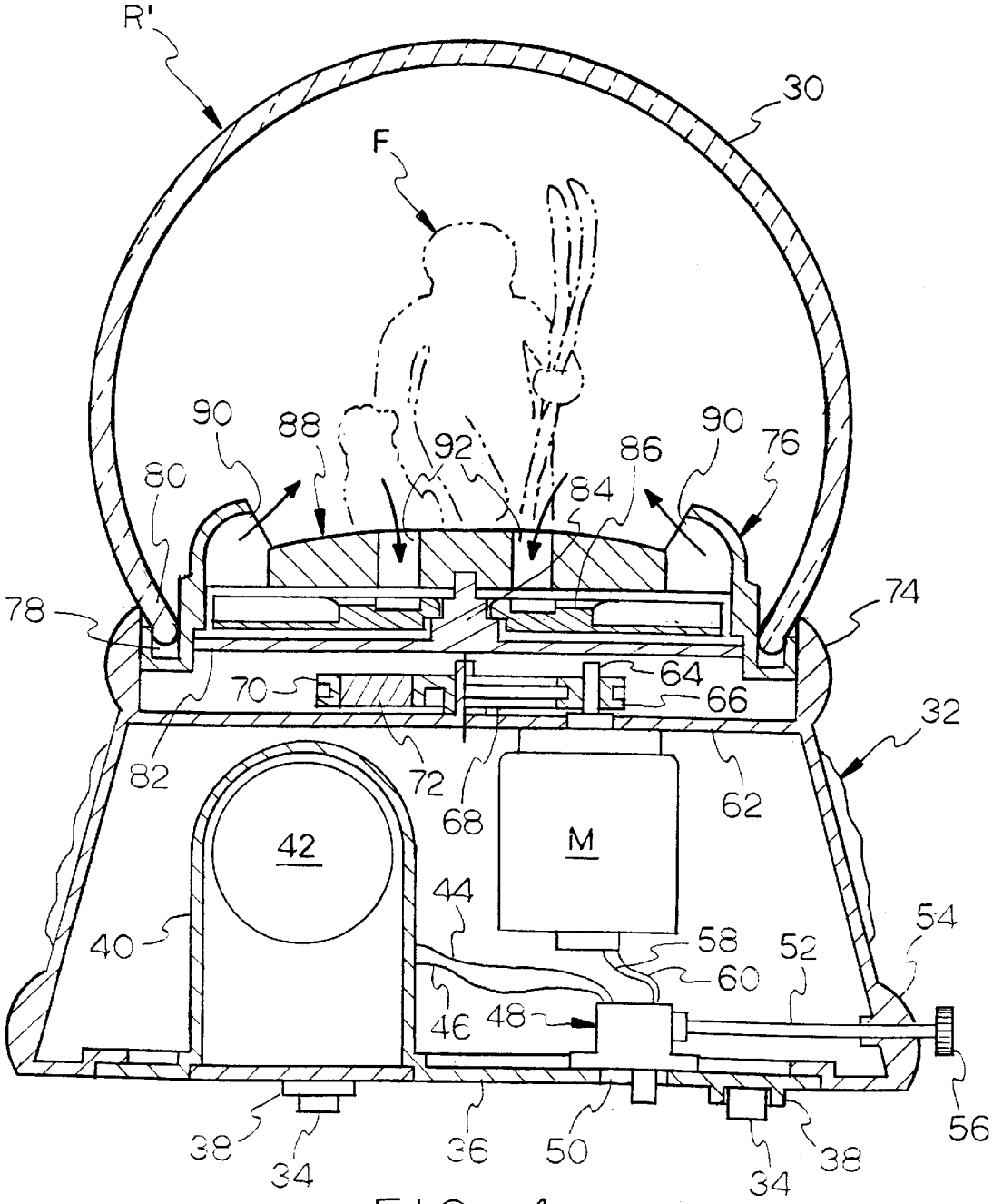
FIG. 4 is a cross-section view of a modification of a invention with an ornament shown in phantom lines.
Figure 5:
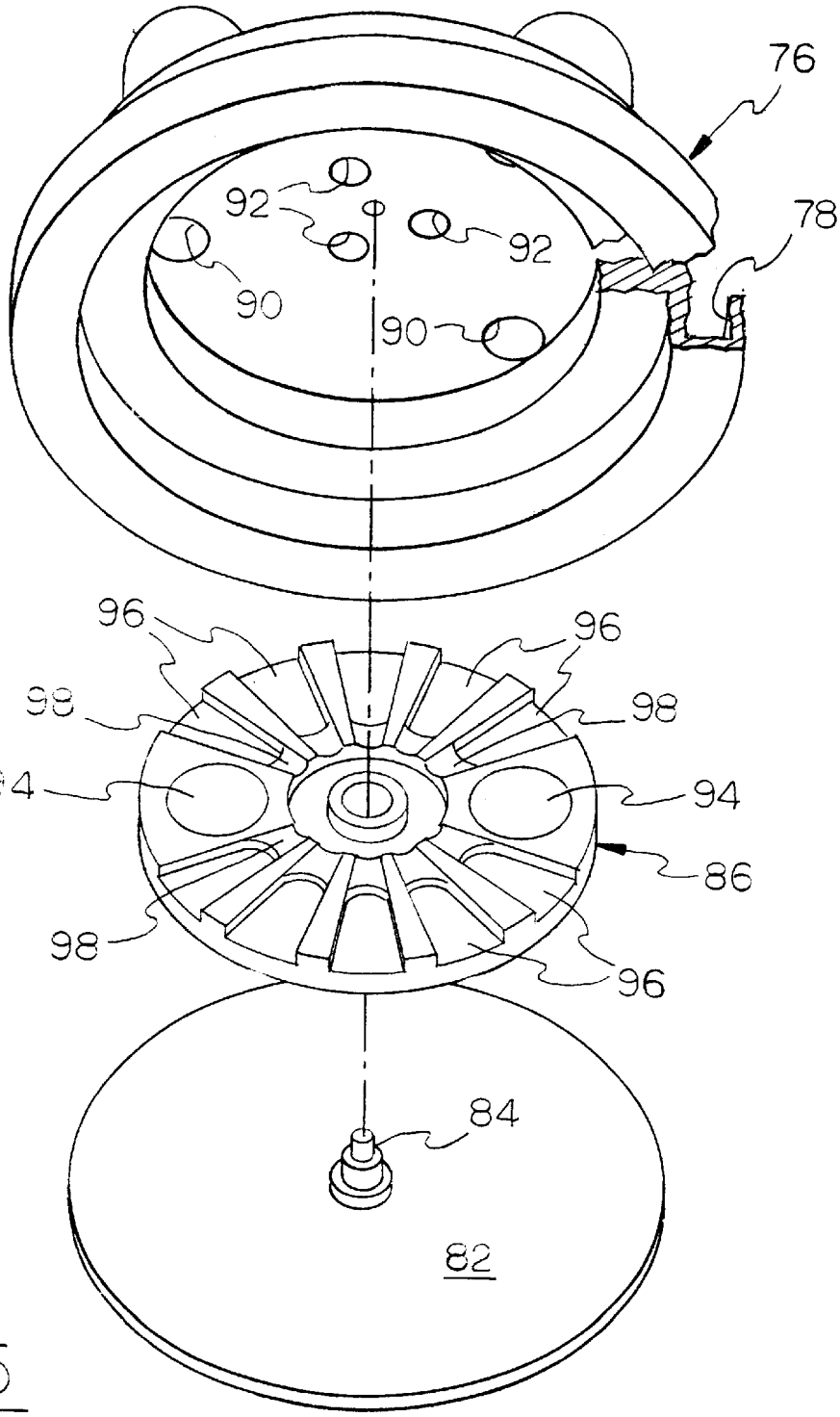
FIG. 5 is an exploded view enlarged of the impeller mechanism.

Operation of FIGS. 4 and 5

In the modification shown in FIGS. 4 and 5, the display receptacle R' includes a transparent envelope 30 which may be of plastic or glass. The transparent envelope 30 is mounted on a base 32. Resilient support pads 34 are provided on the bottom of the base 36. The pads 34 may be of rubber like or cushioning material mounted in cups 38 welded or otherwise molded to the base bottom 36.

The base 32 includes a battery housing 40 for supporting a battery 42. Electrical leads 44 and 46 run from battery 42 to an on/off switch 48 which is mounted on the base bottom 36 and projects through the slot 50 for manipulation of the on/off switch 14. A rod 52 extends through the side wall 54 of the base 32 and is provided with a turning knob 56 which controls a rheostat(not shown) in the on/off switch 48. Leads 58 and 60 extend from the on/off switch 48 to the motor M.

The motor M is supported in the base 32 by the base top 62. The motor M through drive shaft 64 and pinion 66 drives a belt drive 68 which drives a drive wheel 70 having magnets 72 in a manner similar to that shown in FIGS. 1 and 3.

Secured to the base top 62 is an upstanding rim 74 which supports shroud plate 76 having a recess 78 which engages the bottom rim 80 of the transparent envelope 30 which is sealed in the recess 78 to prevent leakage of the fluid in the transparent envelope 30.

The shroud plate 76 includes a bottom plate 82 which is sealed to the shroud plate 76 and prevents fluid from getting into the motor M and the battery 42. The bottom plate 82 has extending upwardly therefrom, a shaft 84 on which is mounted an impeller 86. The shroud plate 76 includes a perforated platform 88 having inwardly flaring fluid outlets 90 and inlets 92, as best shown in FIG. 5.

The impeller 86 includes magnets 94 or magnetic material which will be driven by the drive wheel 70 and its magnets 72. It is obvious that either the drive wheel 70 or the impeller 86 may have opposite by mounted magnets and magnetic devices and still maintain a system in which the drive wheel 70 will drive the impeller 86. Drive wheel 70 and impeller or driven wheel 86 as noted in FIG. 4 are horizontally disposed on parallel planes. The drive wheel 70 and the driven wheel 86 are axially aligned.

The impeller 86 includes radially extending fluted grooves 96 having steps 98.

Operation of FIGS. 4 and 5 Modification

In the operation of the receptacle R' shown in FIGS. 4 and 5, the drive wheel 70 drives the impeller 86, which through the fluted grooves 96 and the steps 98, causes the fluid to circulate through the outlets 90 and into the inlets 92 to cause agitation of the fluid therein thereby causing the particulate which normally lies in the bottom of the receptacle R' to be suspended in the fluid as long as the motor mechanism is operating. Control of the agitation is done through the knob 56 connected to the rheostat(not shown). Obviously other speed reduction devices can be applied including a variable pulley, gearing or shaft friction devices, etc.

As shown in FIG. 4, the perforated platform 88 is stationary and has mounted thereon a figurine F or the like.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An ornamental display receptacle and including:

a) a housing including a base in a transparent envelope;

b) said transparent envelope mounted on said base and sealed therefrom and having a bottom and a top;

c) an ornament mounted in said transparent envelope invisible in said transparent envelope;

d) said transparent envelope including a clear fluid substantially filling said transparent envelope;

e) a visible, agitatable particulate suspendible in said clear fluid and normally resting in said bottom of said transparent envelope in said clear fluid;

f) said housing including fluid agitating means having an on/off device or causing said particulate to be suspended in said fluid when said on/off device is on, and to rest in said bottom of said transparent envelope one said on/off device is off;

g) said fluid agitating means including a motor;

h) said motor including a first rotatable magnetic impeller in said base;

i) said transparent envelope including a perforated flat form;

j) said perforated platform encompassing the second rotatable magnetic impeller;

k) said second rotatable magnetic impeller driveable by said first rotatable magnetic impeller;

l) a second rotatable magnetic material particulate impeller housing;

m) said second rotatable magnetic impeller housing including a bottom plate and a shroud plate;

n) said bottom plate including a support spindle for said second rotatable magnetic impeller;

o) said shroud plate and said bottom plate are connected thereto;

p) said shroud plate is sealed to said base;

q) said shroud plate supports said transparent envelope and is sealed thereto;

r) whereby when said on/off devices on, said clear fluid and said particulate in said envelope will circulate through said perforated platform impelled by said second rotatable magnetic impeller and about said transparent envelope.

2. An ornamental device as in claim 1 and wherein:

a) said transparent envelope includes a bottom edge; and b) said shroud plate includes a recess for engaging said transparent envelope bottom edge.

3. An ornamental device as in claim 2 and wherein:

a) said shroud plate includes said perforated platform.

4. An ornamental device as in claim 3 and wherein:

a) said perforated platform includes spaced deflectors mounted above said second rotatable magnetic impeller.

5. An ornamental device as in claim 3 and wherein:

a) said support spindle extends through into said shroud plate and maintains rotational spacing for said second rotatable magnetic impeller between said bottom plate and said shroud plate.

6. An ornamental device as in claim 5 and wherein:

a) said second rotatable magnetic impeller includes a disc having spaced magnets therein and top and bottom surfaces.

7. An ornamental device as in claim 6 and wherein:

a) said disc includes radial fluted grooves in said top surface.

8. An ornamental device as in claim 7 and wherein:

a) said radial fluted grooves are stepped radially outwardly.

9. An ornamental display receptacle as in claim 1 and wherein:

a) said shroud plate is stationary;

b) said ornament is stationary and mounted on said shroud plate.

* * * * *